United States Patent [19]

Vukich

[11] 4,332,178

[45] Jun. 1, 1982

[54] EXTENDIBLE FINGER WRENCH

[76] Inventor: John Vukich, 6500 E. 88th Ave. #186, Henderson, Colo. 80640

[21] Appl. No.: 180,049

[22] Filed: Aug. 21, 1980

[51] Int. Cl.[3] ..... B25B 15/00

[52] U.S. Cl. ..... 81/439; 81/436

[58] Field of Search ..... 81/439, 436

[56] References Cited

U.S. PATENT DOCUMENTS

| | | | |
|---|---|---|---|
| 2,519,559 | 8/1950 | Foster et al. | 81/439 |
| 2,585,641 | 2/1952 | Faso | 81/436 |
| 2,735,321 | 2/1956 | Browne et al. | 81/436 |

FOREIGN PATENT DOCUMENTS

| | | | |
|---|---|---|---|
| 735181 | 5/1966 | Canada | 81/439 |
| 119028 | 2/1927 | Switzerland | 81/439 |

*Primary Examiner*—Stephen G. Kunin
*Assistant Examiner*—J. T. Zatarga

[57] ABSTRACT

An extendible finger wrench comprising a base member which is elongated, rigid and arcuately curved to conform to the pad side of a finger and has elongated side channels, and a set of interchangeable tool holding members which are rigid, elongated and similarly curved and whose side edges slide into the side channels of the body member. Each tool holding member mounts a different tool at its forward end. Resilient means on the curved surface of the base member hold the tool holding member at any point along the length of the base member, and interacting stop members on the base member and tool holding members allow the tool holding member to extend up to ¾ of its length beyond the base member to extend the reach of the finger wrench.

7 Claims, 6 Drawing Figures

EXTENDIBLE FINGER WRENCH

BACKGROUND OF THE INVENTION

1. Field of the Invention

This invention relates generally to a finger mounted tool base member with interchangeable wrench parts.

2. Description of the Prior Art

Cuthill (Br.); U.S. Pat. No. 564,439; Sept. 27, 1944; 81-177C;

Faso; U.S. Pat. No. 2,585,641; Feb. 12, 1952; 81-177C;

Grayson; U.S. Pat. No. 3,913,646; Oct. 21, 1975; 81-177C.

All the above cited references disclose finger supported tools which can get into and work in close spaces where other tools cannot.

The Br. patent to Cuthill teaches in the modification of FIGS. 1, 2 and 4 a metal finger engaging clip having a housing for a nut.

Faso in its modification of FIG. 16 discloses a finger supported tool comprising a finger sheath having straps to receive the handle of a wrench, and it is suggested that other forms of tools might be substituted.

Grayson discloses a fingertip nut and bolt holding tool.

The present device has a versatility, maneuverability, strength and sturdiness not anticipated by the prior art. For example, the length of the tool may be varied and accordingly the moment of the force may be varied to suit the task at hand.

SUMMARY OF THE INVENTION

It is the primary object of the present device to provide a finger supported tool for the removal and reattachment of screws, nuts, bolts and the like in spaces inaccessible to the hand held tool. Such close working spaces would include for example instrument panels in cars and aircraft and the chassis of radio and television sets.

Because the finger supported tool is so intimately associated with the sensitive pad area of the finger, the smallest movement of the tool and the resulting changes in the amount of force applied are under greater control of the user.

The base member of the tool is made to mount a variety of interchangeable wrenches including a universal nut holder, shallow socket wrench, cross point and standard screwdriver, hex wrench, and a $\frac{1}{4}''$ socket drive. The universal nut holder serves a range of nut sizes and the $\frac{1}{4}''$ socket drive mounts a variety of socket sizes. The other tools may be made in a variety of sizes both standard and metric.

The length of the tools are adjustable within a given range of extension, as is suitable to the size and density of the working area.

The tools are designed to be compact, easy to carry, and so sturdy that they may be palmed and effectively used as hand tools.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
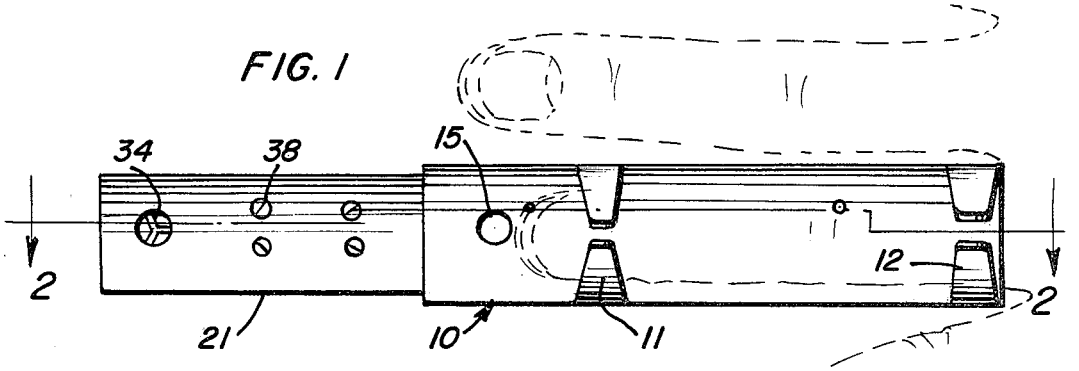
FIG. 1 is a top plan view of the finger wrench in operative position.
Figure 2:
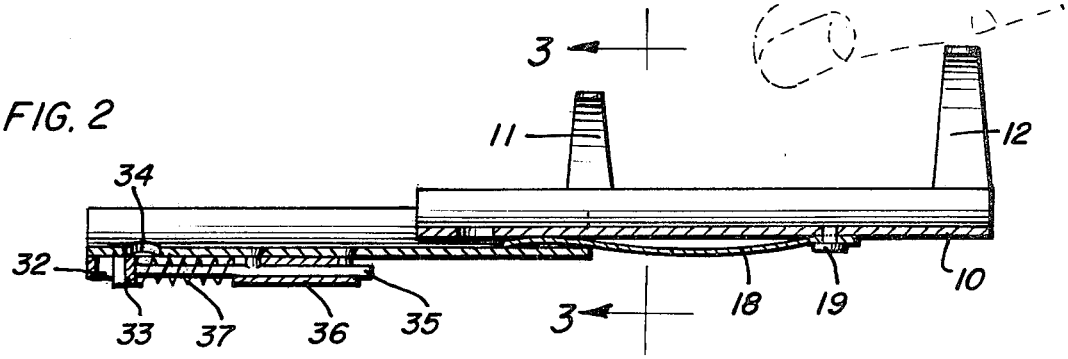
FIG. 2 is a longitudinal cross sectional view taken on line 2—2 of FIG. 1.
Figure 3:
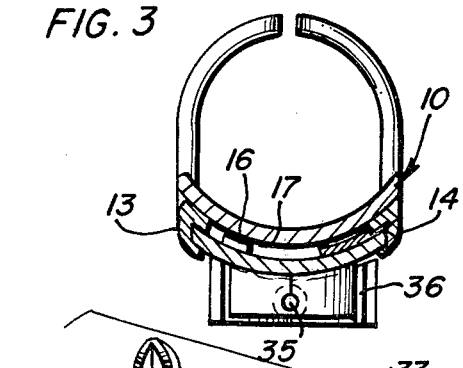
FIG. 3 is a cross sectional view taken on 3—3 of FIG. 2.
Figure 4:
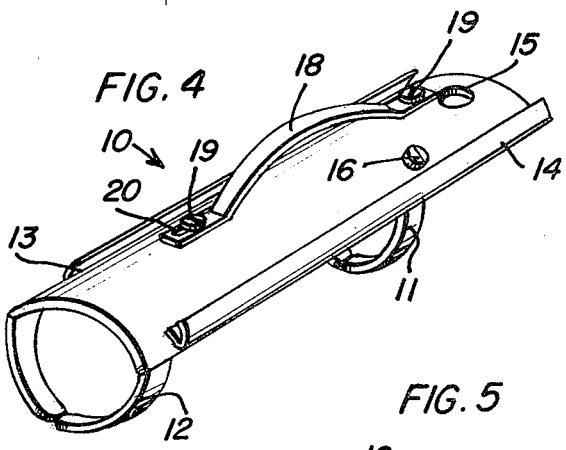
FIG. 4 is a view of the base member.
Figure 5:
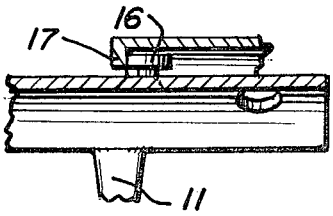
FIG. 5 is a broken sectional view illustrating the action of the stop mechanism.
Figure 6:
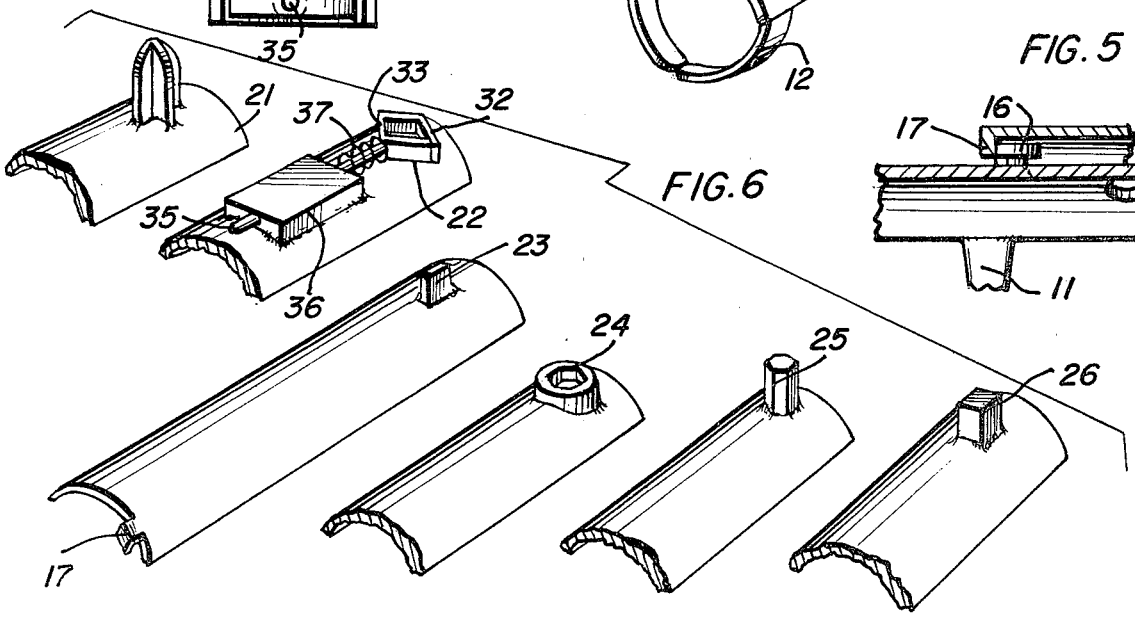
FIG. 6 is a view of the set of interchangeable tool carrying members adapted to slide onto the base member shown in FIG. 4.

Referring now more particularly to FIGS. 1–6 of the drawings, the numeral 10 has been designated to represent the base member. The base member 10 as seen in FIG. 4 is elongated, rigid, and arcuate in cross section to conform to the finger of the hand and provide in effect a finger cot or support. It extends at least a fingers length, or about four inches, and has appended to it loops 11 and 12 to adjustably attach it to any finger of either hand. In FIG. 1 of the drawings the base member 10 is shown as attached to the index finger of the right hand for purposes of illustration. The loops 11 and 12 may take the form of split rings, loop 12 being at the basal end and loop 11 nearer the distal end of the base member. Side channels 13 and 14 extend substantially the full length of the base member 10. A clearance opening 15 is located centrally widthwise of the base member and near its distal end. A stop member 16 as shown in FIGS. 3, 4 and 5 is raised above the convex surface of the base member and limits the forward extension of the interchangeable tool holder members with respect to the base member as will hereinafter be more fully described. Stop member 16 is positioned to one side of the opening 15 nearer to channel 13, and one inch inwardly of the distal end of the base member. The set of interchangeable tool holding members 30 as illustrated in FIG. 6 are rigid, elongated and arcuately concentric with the base member 10. The tool holders are adapted to slide onto the base member 10 with their longitudinal edges engaging in the side channels 13, 14 of the base member. Each tool holding member has a stop 17 depending from its concave surface at its basal end, see FIGS. 3, 4 and 5 of the drawings. The stop 17 is positioned to one side in order to abut stop 16 on base member 10 $\frac{1}{4}$ way inward from its distal end thus limiting the maximum extension of the tool holder beyond the finger base member to $\frac{3}{4}$ the total length of the base member. A tension spring member 18 which here takes the form of a bowed metal elongated strap is fixedly secured at each end to the base member 10 by rivets 19. The said strap 18 has an elongated opening 20 at one end adjacent to one of the rivet connections so that when the tool holding member rides over the convex surface of the base member the spring 18 will have room to flatten and extend and thereby frictionally engaged the tool holding member. The tool holding member may be held in any position between completely overlapping the base member 10, to extending over the distal end of the base member by $\frac{3}{4}$ the length of the base member, at which point stops 17 and 16 abut.

Each of the tool holding members 21–26 inclusive as shown in FIG. 6 has as its distal end a tool which is adapted to remove as by twisting screws, nuts and bolts and the like and to retighten them when they are being replaced. The set of tool holding members 30 are shown in full and partial view in FIG. 6 and comprise a cross-point or Phillips screwdriver post 21, a universal nut holder 22, a straight screwdriver post 23, a shallow socket wrench 24, a hex wrench 25 and a ¼" socket drive 26. The screwdrivers, shallow socket and hex wrenches are provided in different sizes. The ¼" drive shown on tool 26 is able to receive both the standard and metric sized socket wrenches. All of these tools are readily interchangeable and easily slipped onto and off the base member.

In FIGS. 1–3 inclusive the tool holder shown on the base member at maximum extension is the universal nut holder 22. In FIG. 1 the base member 10 is applied to the under or pad side of the finger. The universal nut holder comprises a fixed jaw 32 and a moveable jaw 33 which surround a clearance opening 34. The opening allows a long stem screw or bolt to extend therethrough. The moveable jaw 33 is attached to a shaft 35 which is slideable in bearing box 36. The box itself is screwed to the tool holding member 22 by screws 38, bolts or the equivalent. A compression spring 37 is mounted on the shaft 35, between the bearing box 36 and the moveable jaw 33. The jaw 33 is retractable to accommodate any sized nut, and compression spring 37 urges it into close engagement with the nut. When this tool is to be used without extension, clearing holes 34 and 15 may be aligned to allow a long stem screw to extend therethrough. The shallow hexagonal socket wrench 24 is similarly provided with a clearance opening.

The tools are preferably fabricated from electrical type thin wall conduit, one inch in diameter. The commercial availability of such conduit simplifies and makes the manufacture of the tool more economical. The resulting steel tool is sturdy, strong and compact and may be used as a hand tool as well as a finger tool.

Aluminum tubing would make for a lighter weight tool. When aluminum is used the side channels are formed integrally with the base member, and not as a separate element as shown in FIGS. 3 and 4 of the drawings.

When the finger wrench is to be used with electrical equipment, obviously a non-conductor such as rigid plastic material would better serve the purpose, and the base member and the tool holding member as herein described, could be made of such a plastic material.

The finger loops 11 and 12 as shown in FIGS. 1–3 inclusive of the drawings may be plastic coated for comfort and grip.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A tool set adapted to be used for removing and replacing connections in areas of limited accessibility comprising an elongated transversely arcuate rigid base member with side channels extending along both elongated edges, first stop means on the base member near its forward end, and a set of interchangeable tool carrying members each adapted to be carried individually on the said base member and comprising an elongated rigid member concentrically arcuate with the base member so as to be able to slide onto the base member with the side edges of the tool carrying member slideably engaged within the said side channels, a second cooperating stop means near the back end of the tool carrying member, a different tool element mounted at the forward end of each tool carrying member, the said first stop means and the said second stop means adapted to abut when the base member and the tool carrying member are at their maximum extension, frictional gripping means on the base member to hold the tool carrying member at any point along the length of the base member so as to provide a tool of optionally varying length, said frictional gripping means comprising a bowed tension spring extending parallel to the length of the base member and secured to it at each of its ends, said spring having an opening at one end to allow room for the flattening of the spring when the tool carrying member rides over it.

2. A tool set as defined in claim 1, wherein the said tool element mounted at the forward end of each tool carrying member is from the class of wrenches including hex, socket, screwdriver and nut holder.

3. A tool set as defined in claim 1 wherein the first stop means comprises a bump on the convex surface of the base member, and the second stop means comprises a detent depending from the concave surface of the tool carrying member.

4. A tool set as defined in claim 3 wherein the bump on the convex surface of the base member is approximately ¼ the length of the base member from its forward edge to provide an overlap at maximum extension so that the tool will remain sturdy and rigid, and the said detent depends from the rear of the tool carrying member.

5. A tool set as defined in claim 1 wherein the base member is provided with a clearance opening at its forward end.

6. A tool set as defined in claim 1 wherein the said base member is provided with loops to attach it to a finger.

7. A tool set as defined in claim 6 wherein the said loops are plastic coated split rings.

* * * * *